US012276189B2

(12) United States Patent
Chen et al.

(10) Patent No.: US 12,276,189 B2
(45) Date of Patent: Apr. 15, 2025

(54) ANTI-COLLISION WELL TRAJECTORY DESIGN

(71) Applicant: Schlumberger Technology Corporation, Sugar Land, TX (US)

(72) Inventors: Xin Chen, Beijing (CN); Qing Liu, Beijing (CN); Lu Jiang, Beijing (CN); XiaoWei Sheng, Beijing (CN); Paul Bolchover, Beijing (CN)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 566 days.

(21) Appl. No.: 17/597,424

(22) PCT Filed: Jul. 7, 2020

(86) PCT No.: PCT/US2020/040969
§ 371 (c)(1),
(2) Date: Jan. 5, 2022

(87) PCT Pub. No.: WO2021/007194
PCT Pub. Date: Jan. 14, 2021

(65) Prior Publication Data

US 2022/0268147 A1 Aug. 25, 2022

Related U.S. Application Data

(60) Provisional application No. 62/871,759, filed on Jul. 9, 2019.

(51) Int. Cl.
*E21B 47/02* (2006.01)
*E21B 7/04* (2006.01)
(Continued)

(52) U.S. Cl.
CPC ..... *E21B 47/02* (2013.01); *E21B 7/04* (2013.01); *E21B 43/30* (2013.01); *E21B 47/022* (2013.01)

(58) Field of Classification Search
CPC . E21B 47/02; E21B 7/04; E21B 43/30; E21B 47/022
See application file for complete search history.

(56) References Cited

U.S. PATENT DOCUMENTS 6,834,732 B2 12/2004 Haarstad
2008/0289877 A1 11/2008 Nikolakis-Mouchas
(Continued)

FOREIGN PATENT DOCUMENTS

WO 2009142782 A2 11/2009
WO WO-2014116948 A1 * 7/2014 ..... E21B 43/017
(Continued)

OTHER PUBLICATIONS

WO-2014116948-A1_translated (Year: 2014).*
(Continued)

*Primary Examiner* — Natalie Huls
*Assistant Examiner* — Michael J Singletary
(74) *Attorney, Agent, or Firm* — Jeffrey D. Frantz

(57) ABSTRACT

Techniques for determining trajectories for a plurality of wells while avoiding collision between wells are presented. The techniques can include determining a zone of uncertainty for individual wells of the plurality of wells, determining a minimum separation factor for individual wells of the plurality of wells, determining a gradient of a separation factor for at least one pair of wells of the plurality of pairs of wells, updating a nudge position for at least one well, and providing nudge positions for the individual wells of the plurality of wells.

20 Claims, 14 Drawing Sheets

(51) Int. Cl.
*E21B 43/30* (2006.01)
*E21B 47/022* (2012.01)

(56) References Cited

U.S. PATENT DOCUMENTS

| | | | | |
|---|---|---|---|---|
| 2009/0200014 | A1* | 8/2009 | Schottle | E21B 7/06 166/245 |
| 2010/0271232 | A1 | 10/2010 | Clark et al. | |
| 2012/0221307 | A1 | 8/2012 | Schottle et al. | |
| 2014/0209300 | A1* | 7/2014 | Tilke | E21B 41/00 702/6 |
| 2015/0019134 | A1 | 1/2015 | Sawaryn | |
| 2016/0090822 | A1* | 3/2016 | Lu | E21B 7/10 703/1 |
| 2020/0256181 | A1* | 8/2020 | Jamieson | E21B 7/00 |

FOREIGN PATENT DOCUMENTS

| | | | | |
|---|---|---|---|---|
| WO | 2016049272 | A1 | 3/2016 | |
| WO | WO-2021007194 | A1 * | 1/2021 | E21B 43/30 |

OTHER PUBLICATIONS

WO-2021007194-A1_translated (Year: 2021).*
Extended Search Report issued in European Patent Application No. 20836909.0 dated Jun. 16, 2023, 10 pages.
Jamieson, A., "Introduction to wellbore positioning", Wellbore Positioning, 2012, V01.5.14, 164 pages, retrieved from the internet on Dec. 21, 2015 at [https://www.uhi.ac.uk/en/research-enterprise/Introduction to Wellbore Positioning_V01.5.14.pdf].
Search Report and Written Opinion of International Patent Application No. PCT/US2020/040969.

* cited by examiner

ANTI-COLLISION WELL TRAJECTORY DESIGN

RELATED APPLICATION

This application is a national stage entry under 35 U.S.C. 371 of International Application No. PCT/US2020/040969, entitled "Anti-Collision Well Trajectory Design", and filed Jul. 7, 2020, which claims priority to, and the benefit of, U.S. Provisional Patent Application No. 62/871,759, entitled "Approaches to Reducing the Risk of Collision in Trajectory Design", and filed Jul. 9, 2019, which is hereby incorporated by reference in its entirety.

BACKGROUND

The trajectories of wells, e.g., petroleum wells, are typically planned and designed before drilling commences. When planning well trajectories, the risk of collision between wells is considered. For example, designers may utilize a trajectory nudge operation to reduce the risk of collisions between wells. A trajectory nudge operation adjusts the trajectory segment in a specified direction and by a specified distance, where the nudging distance and direction is defined on the cross section of trajectory, e.g., most of the cases focus on the anti-collision issue on vertical section of designed draft trajectory, and the nudge direction and distance can be denoted on horizontal plane. Traditionally, the nudge distance and direction are chosen by experience of drilling engineers, which usually costs large amounts of time, especially when considering multiple well trajectories. Moreover, it is complicated to find the direction and distance for nudging trajectories, and it gets worse when multiple well trajectories need be designed.

SUMMARY

According to various embodiments, a computer-implemented method of determining trajectories for a plurality of wells while avoiding collision between wells is presented. The method includes determining a zone of uncertainty for individual wells of the plurality of wells, whereby a plurality of zones of uncertainty are determined; determining, based on the plurality of zones of uncertainty, a minimum separation factor for individual wells of the plurality of wells, whereby a plurality of minimum separation factors are determined; determining, based on at least one zone of uncertainty of the plurality of zones of uncertainty, a gradient of a separation factor for at least one pair of wells of the plurality of pairs of wells, whereby at least one separation factor gradient is determined; updating a nudge position for at least one well, based on at least one of the at least one separation factor gradient and based on at least one minimum separation factor of the plurality of separation factors; and providing, based on the updating, nudge positions for the individual wells of the plurality of wells.

Various optional features of the above embodiments include the following. The nudge positions for the individual wells of the plurality of wells may cause the individual wells to avoid an obstacle. The nudge positions for the individual wells of the plurality of wells may cause at least one well to intersect a target. The plurality of wells may include at least three wells. The plurality of minimum separation factors may be based on an oriented separation factor formula. At least one zone of uncertainty of the plurality of zones of uncertainty zone of uncertainty may lie in a plane and comprises at least one of an ellipse or a pedal curve. The updating the nudge position may include updating a position matrix with a move matrix comprising a plurality of nudge vectors. The method may further include iterating, prior to the providing, the determining the zone of uncertainty, the determining the minimum separation factor, the determining the gradient of the separation factor, and the updating, until a stop condition occurs. The stop condition may include at least one of a global minimum separation factor being above a predetermined threshold or a number of iterations exceeding a predetermined iteration ceiling, wherein the global minimum separation factor is based on the plurality of minimum separation factors. The method may include not updating a nudge position for at least one well based on its minimum separation factor exceeding a threshold.

According to various embodiments, a computer system for determining trajectories for a plurality of wells while avoiding collision between wells is presented. The system includes at least one electronic processor that executes instructions to perform operations comprising: determining a zone of uncertainty for individual wells of the plurality of wells, whereby a plurality of zones of uncertainty are determined; determining, based on the plurality of zones of uncertainty, a minimum separation factor for individual wells of the plurality of wells, whereby a plurality of minimum separation factors are determined; determining, based on at least one zone of uncertainty of the plurality of zones of uncertainty, a gradient of a separation factor for at least one pair of wells of the plurality of pairs of wells, whereby at least one separation factor gradient is determined; updating a nudge position for at least one well, based on at least one of the at least one separation factor gradient and based on at least one minimum separation factor of the plurality of separation factors; and providing, based on the updating, nudge positions for the individual wells of the plurality of wells.

Various optional features of the above embodiments include the following. The nudge positions for the individual wells of the plurality of wells may cause the individual wells to avoid an obstacle. The nudge positions for the individual wells of the plurality of wells may cause at least one well to intersect a target. The plurality of wells may include at least three wells. The plurality of minimum separation factors may be based on an oriented separation factor formula. At least one zone of uncertainty of the plurality of zones of uncertainty may lie in a plane and comprises at least one of an ellipse or a pedal curve. The updating the nudge position may include updating a position matrix with a move matrix comprising a plurality of nudge vectors. The operations may further include iterating, prior to the providing, the determining the zone of uncertainty, the determining the minimum separation factor, the determining the gradient of the separation factor, and the updating, until a stop condition occurs. The stop condition may include at least one of a global minimum separation factor being above a predetermined threshold or a number of iterations exceeding a predetermined iteration ceiling, wherein the global minimum separation factor is based on the plurality of minimum separation factors. The operations may further include not updating a nudge position for at least one well based on its minimum separation factor exceeding a threshold.

The foregoing summary is presented merely to introduce some of the aspects of the disclosure, which are described in greater detail below. Accordingly, the present summary is not intended to be limiting.

BRIEF DESCRIPTION OF THE DRAWINGS

The accompanying drawings, which are incorporated in and constitute a part of this specification, illustrate examples of the present teachings and together with the description, serve to explain the principles of the present teachings. In the figures.

DETAILED DESCRIPTION

Figure 1:
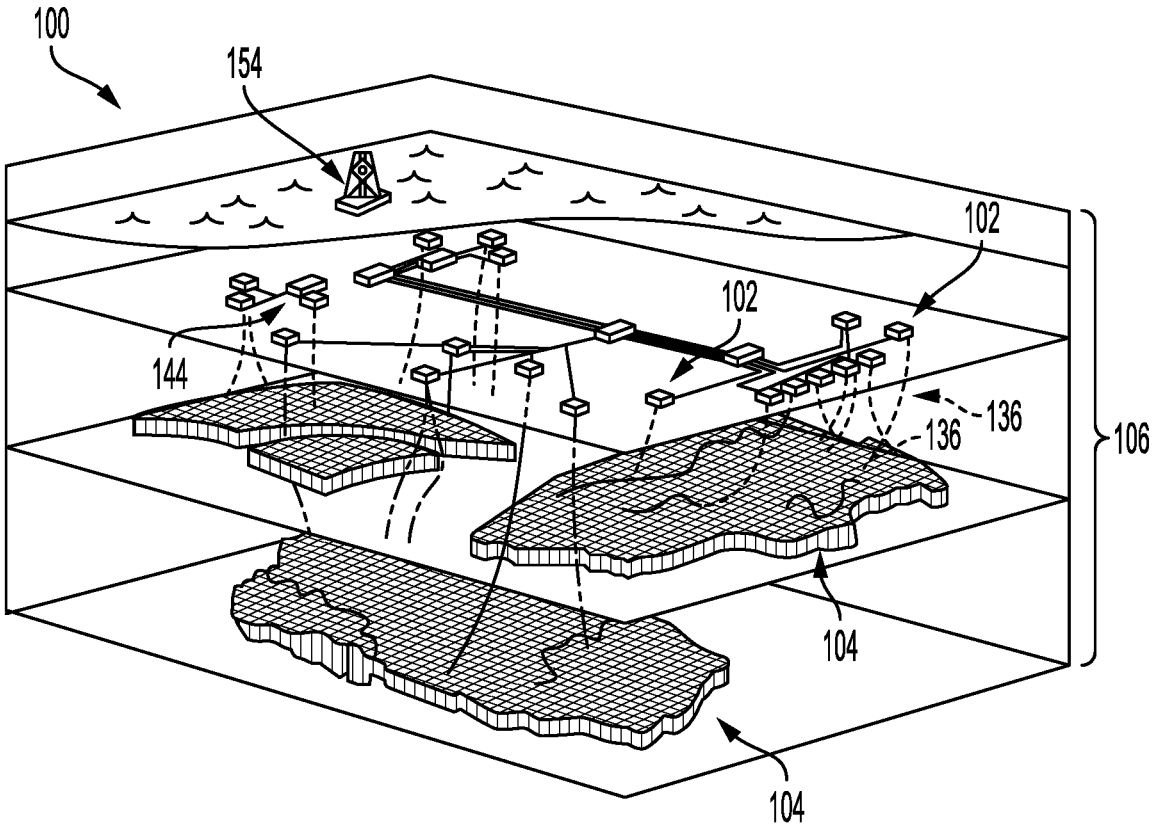
FIG. 1 illustrates an oilfield in accordance with some examples disclosed herein.

The following detailed description refers to the accompanying drawings. Wherever convenient, the same reference numbers are used in the drawings and the following description to refer to the same or similar parts. While several examples and features of the present disclosure are described herein, modifications, adaptations, and other implementations are possible, without departing from the spirit and scope of the present disclosure.

Some examples provide techniques for finding directions and distances for nudge operations for well trajectories. Some examples utilize an analytic geometric model defined in three-dimensional space to find nudge solutions quickly. The algorithm complexity may not be larger than O(n), where n is the number of trajectories to be designed. Examples may be applied to several situations of well trajectory design, including:

(1) Trajectory design, considering the drilled offset well collision issue;

(2) Pad design with multiple well trajectories;

(3) Obstacle constraint trajectory design; and (4) Target approach trajectory design.

The input for some examples includes the basic information used for trajectory design, e.g., surface locations of planning well trajectories and offset well trajectory data, well path and well placement, uncertainty information, etc. According to some examples, the input information includes the well surface locations and information sufficient to determine zones of uncertainty for each well trajectory. The output of some examples includes a set of recommended collision-free nudging vectors (i.e., azimuth direction and distance). Such vectors may be selected with respect to anti-collision nudge direction and distance in three-dimensional space. As described in detail herein, the gradients of a quantitative separation factor may be used for such optimization. A reduction to practice has been constructed and successfully tested.

FIG. 1 illustrates an oilfield 100 in accordance with implementations of various technologies and techniques described herein. As shown, the oilfield has a plurality of wellsites 102 operatively connected to central processing facility 154. The oilfield configuration of FIG. 1 is not intended to limit the scope of the anti-collision trajectory design techniques disclosed herein. Part, or all, of the oilfield may be on land and/or sea. Also, while a single oilfield with a single processing facility and a plurality of wellsites is depicted, any combination of one or more oilfields, one or more processing facilities and one or more wellsites may be present.

Wellsites 102 have equipment that forms wellbores 136 into the earth. The wellbores 136 may extend through subterranean formations 106, including reservoirs 104. These reservoirs 104 contain fluids, such as hydrocarbons. The wellsites draw fluid from the reservoirs and pass them to the processing facilities via surface networks 144. The surface networks 144 have tubing and control mechanisms for controlling the flow of fluids from the wellsite to processing facility 154.

The placement of wellsites 102 and the trajectories of their wellbores 136 may be designed using examples disclosed herein. Such design may be performed automatically using electronic computer equipment, and the trajectories may be ensured to be collision-free. Examples are expected to shorten the period of the entire well planning process. Traditionally, when dealing with multiple-trajectory design and considering the anti-collision issue, a difficult part is the very time-consuming testing by a well path designer. Examples may expedite the well design process, and the results may be implemented directly so as to benefit the planning process.

Figure 2:
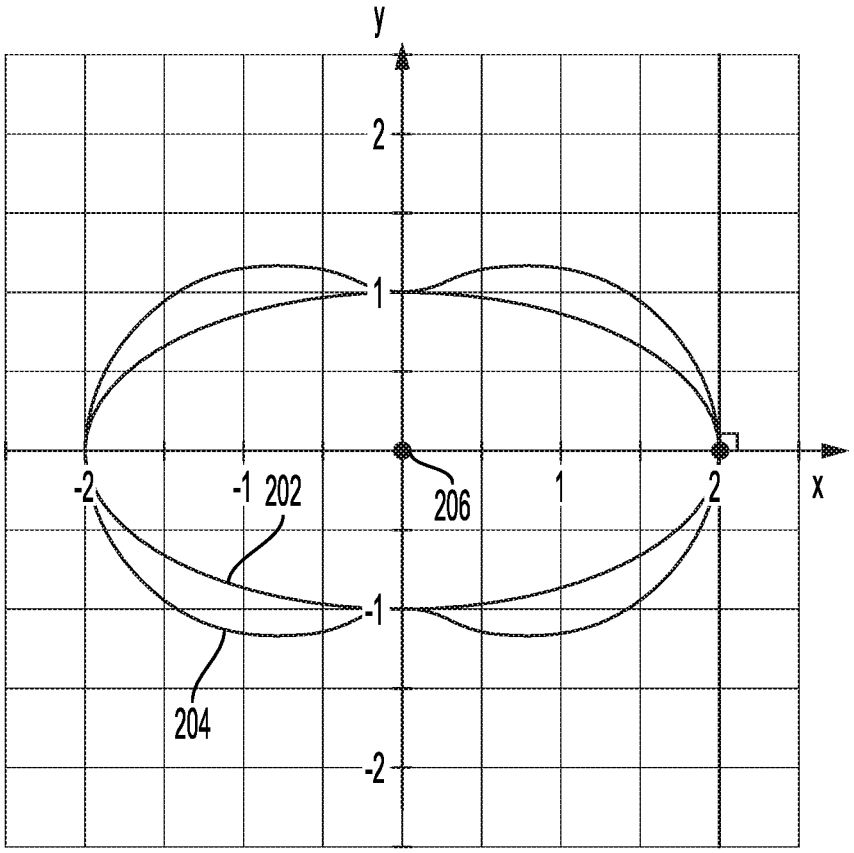
FIG. 2 illustrates an ellipse and pedal curve representing a zone of uncertainty according to some examples disclosed herein.

FIG. 2 illustrates an ellipse 202 and pedal curve 204 representing a zone of uncertainty according to some examples disclosed herein. In general, when drilling a well, the borehole may deviate from its expected position. To quantify such deviation, examples may consider zones of uncertainty, which specify a range of locations for the actual position of the borehole. Zones of uncertainty may be considered as, for example, three-dimensional ellipsoids, two-dimensional ellipses, or two-dimensional pedal curves of ellipses. The three-dimensional ellipsoids may have their major axes perpendicular to the wellbore direction. The ellipses and pedal curves may lie in a two-dimensional plane parallel with the surface, again with their major axes perpendicular to the wellbore direction. The three-dimensional ellipsoids may be projected onto two-dimensional planes, e.g., parallel to the surface, to derive two-dimensional ellipses of uncertainty.

Ellipse 202 and pedal curve 204 may be determined for a borehole 206 through the origin (0,0) and perpendicular to the page. Ellipse 202 of FIG. 2 may be expressed as an algebraic equation, by way of non-limiting example, $x^2/a^2+y^2/b^2=1$, where (x,y) is a point on the ellipse, a represents the semi-major axis length, and b represents the semi-minor axis length. Pedal curve 204 for ellipse 202 may be expressed as, by way of non-limiting example, $(x^2+y^2)^2=a^2x^2+b^2y^2$, with the same parameters. Ellipses and pedal curves that are not centered at the origin and which axes are not parallel or perpendicular to the x and y axes may utilize different equations.

Examples may use zones of uncertainty to determine separation factors, described presently.

Figure 3:
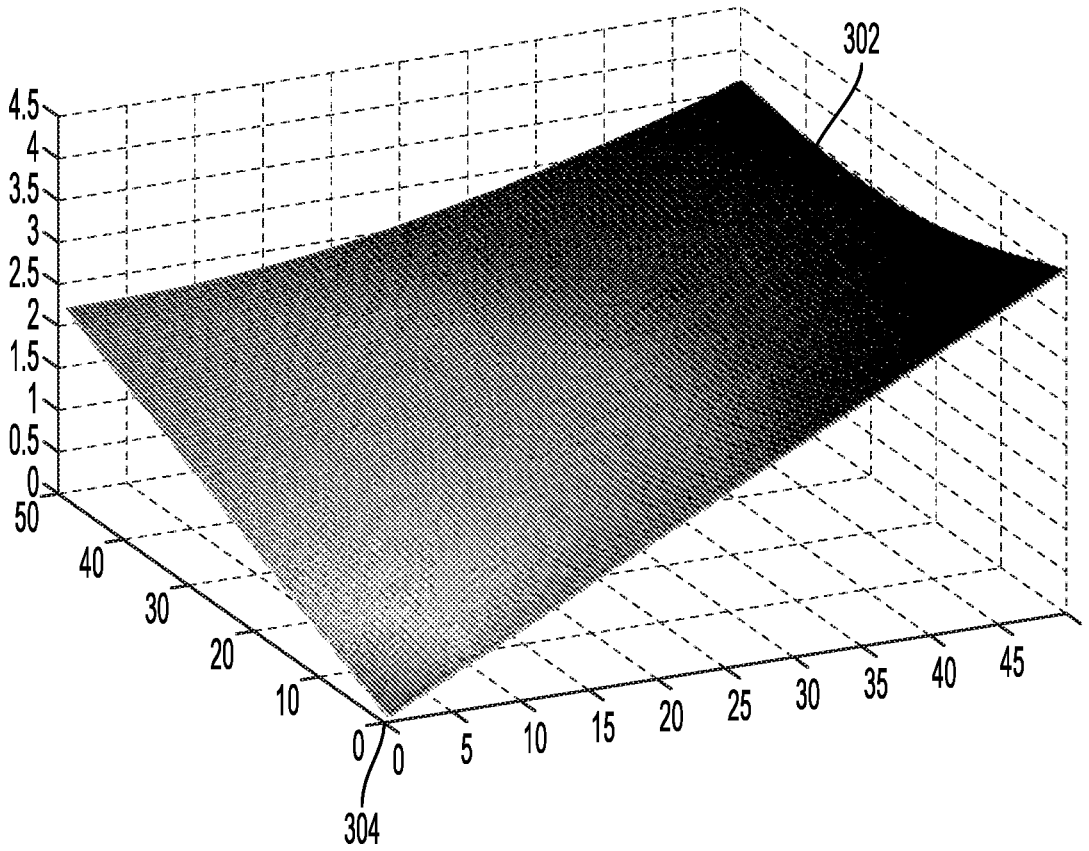
FIG. 3 illustrates a surface representing separation factor values corresponding to well locations according to some examples disclosed herein.

FIG. 3 illustrates a surface 302 representing separation factor values corresponding to well locations according to some examples disclosed herein. There are several metrics for collision risk in well trajectories, e.g., Separation Factor (SF), Oriented Separation Factor (OSF), etc. Herein, each such metric is referred to as a "separation factor". As separation factor values get larger, the collision risk gets smaller. Thus, as shown in FIG. 3, the height of surface 302 depicts the separation factor between an offset well at the origin (0, 0) 304 and a primary well at a corresponding position on the xy-plane.

Separation factors may be defined as mathematical functions of spatial distance and well placement uncertainty. Thus, separation factors may be defined in part using ellipsoids, projected ellipses, ellipse-based pedal curves, or any other zones of uncertainty. For example, the separation factor for two wells with known ellipses of uncertainty at a location along their wellbores in a horizontal plane may be determined as the distance between the wellbore centers divided by the sum of (1) the distance between the first well's center and the point on its respective ellipse of uncertainty (or corresponding pedal curve) that lies on a line connecting the wellbore centers and (2) the distance between the second well's center and the point on its respective ellipse of uncertainty (or corresponding pedal curve) that lies on the line connecting the wellbore centers. Other formulas are possible. For example, for wellbores with known ellipsoids of uncertainty, such ellipsoids may be projected onto the horizontal plane to form ellipses, and the preceding formula may be used.

Some examples utilize a separation factor as a measurement for the collision issue. In particular, some examples utilize a gradient of a separation factor, as shown and described presently in reference to FIG. 4.

Figure 4:
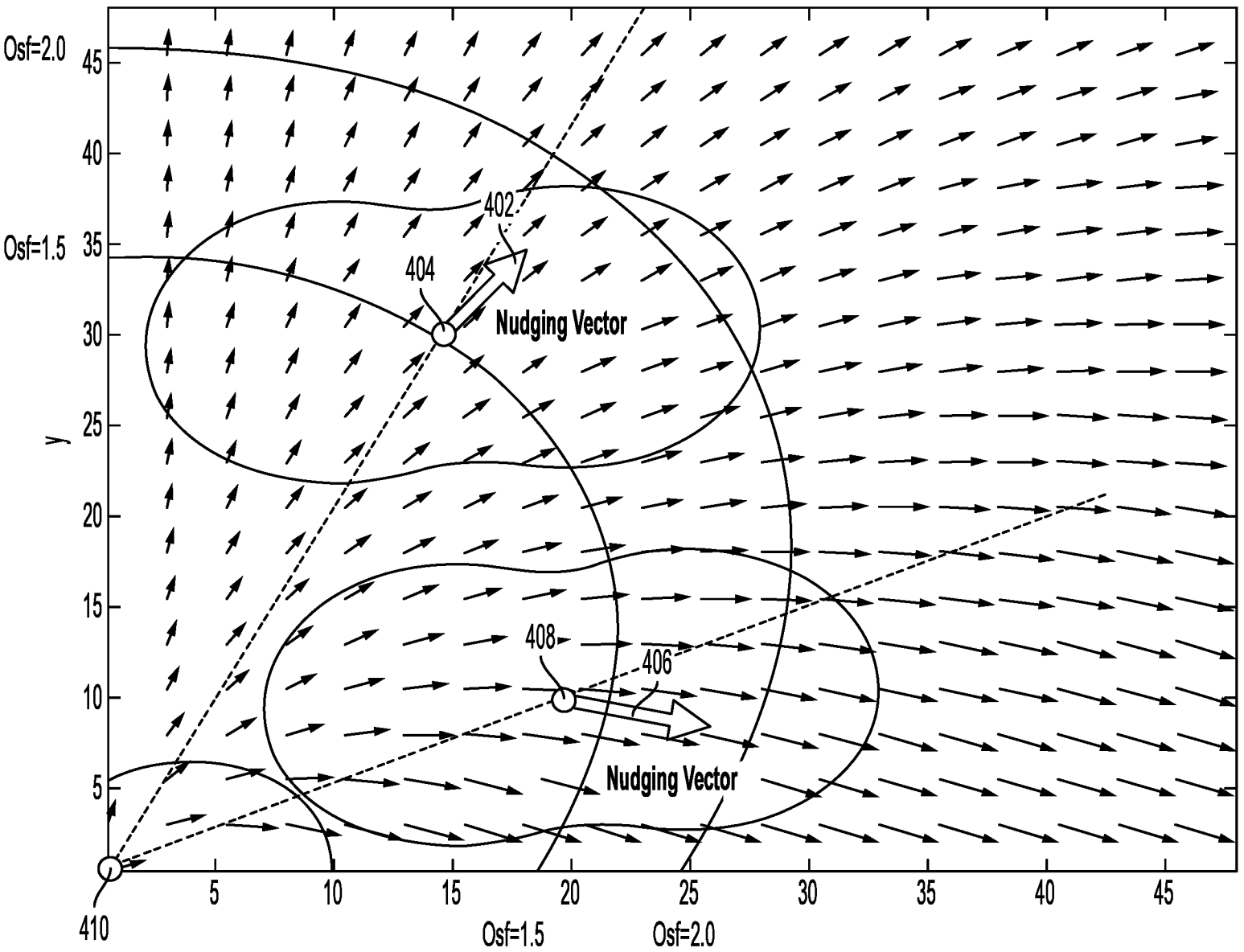
FIG. 4 illustrates nudge directions for wells according to some examples disclosed herein.

FIG. 4 illustrates nudge directions for wells 404, 408 according to some examples disclosed herein. In particular, relative to offset well 410 at the origin, FIG. 4 depicts a vector field representing a gradient of a separation factor for primary wells 404, 408 at various locations in the field. For primary well 404, vector 402 indicates a direction in which the separation factor relative to offset well 410 diminishes the fastest, which may be used as a nudge direction according to various examples. Likewise, for primary well 408, vector 406 indicates the direction of maximal separation factor decrease relative to offset well 410. Vector 406 may thus be used for a nudge direction according to various examples. Contour lines in FIG. 4 mark locations at which a separation factor, here an oriented separation factor, is equal to thresholds 1.5 and 2.0.

Figure 5:
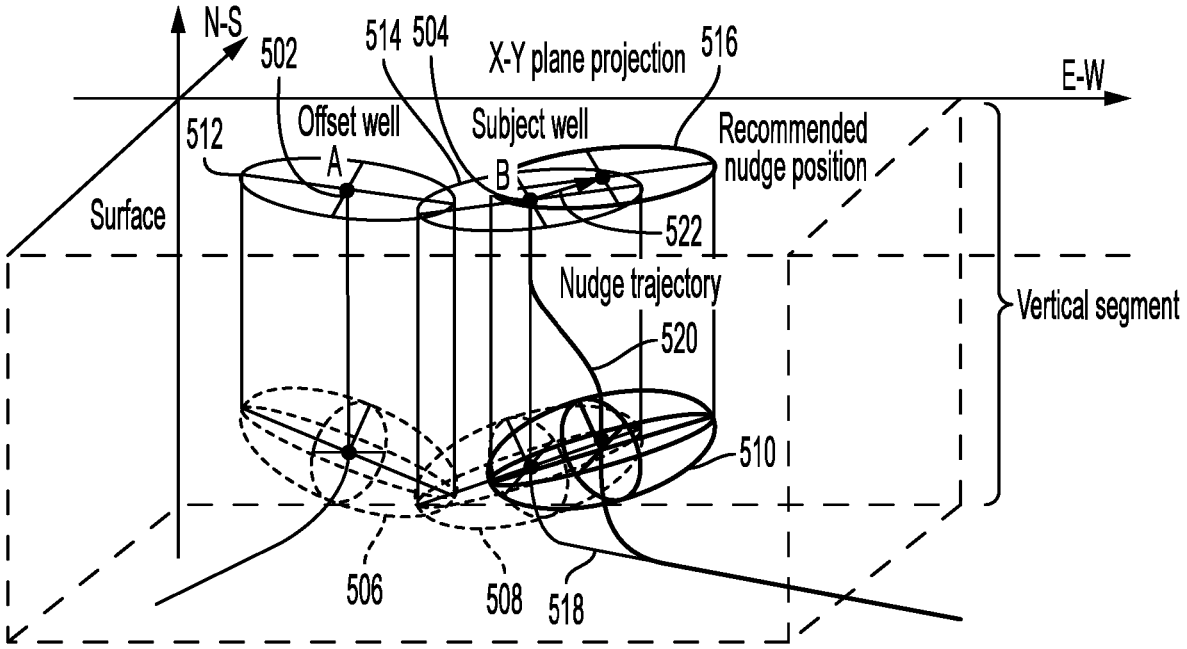
FIG. 5 illustrates a nudged well trajectory according to some examples disclosed herein.

FIG. 5 illustrates a nudged well trajectory 520 according to some examples disclosed herein. In particular, FIG. 5 depicts offset well 502 with wellsite at location A on the surface and subject well 504 with wellsite at location B on the surface. Both original trajectory 518 and nudged trajectory 520 of subject well 504 are shown. Original trajectory 518 is associated with three-dimensional ellipsoid of uncertainty 506 and its two-dimensional projected ellipse of uncertainty 512. Nudged trajectory 520 is associated with three-dimensional ellipsoid of uncertainty 510 and its two-dimensional projected ellipse 516. Ellipsoid of uncertainty 506 for offset well 502 and ellipsoid of uncertainty 508 for original trajectory 518 of subject well 504 intersect, indicating that the trajectories may collide. Ellipsoid of uncertainty 510 for nudged trajectory 520 does not intersect ellipsoid of uncertainty 506 for offset well, indicating that their respective trajectories are collision free. Nudge vector 522 indicates the direction (e.g., azimuth direction) and magnitude (e.g., distance) of the nudge used to obtain nudged trajectory 520 from original trajectory 518. Examples may be used to obtain nudge vector 522 for avoiding collision between the trajectories of wells 502, 504.

Figure 6:
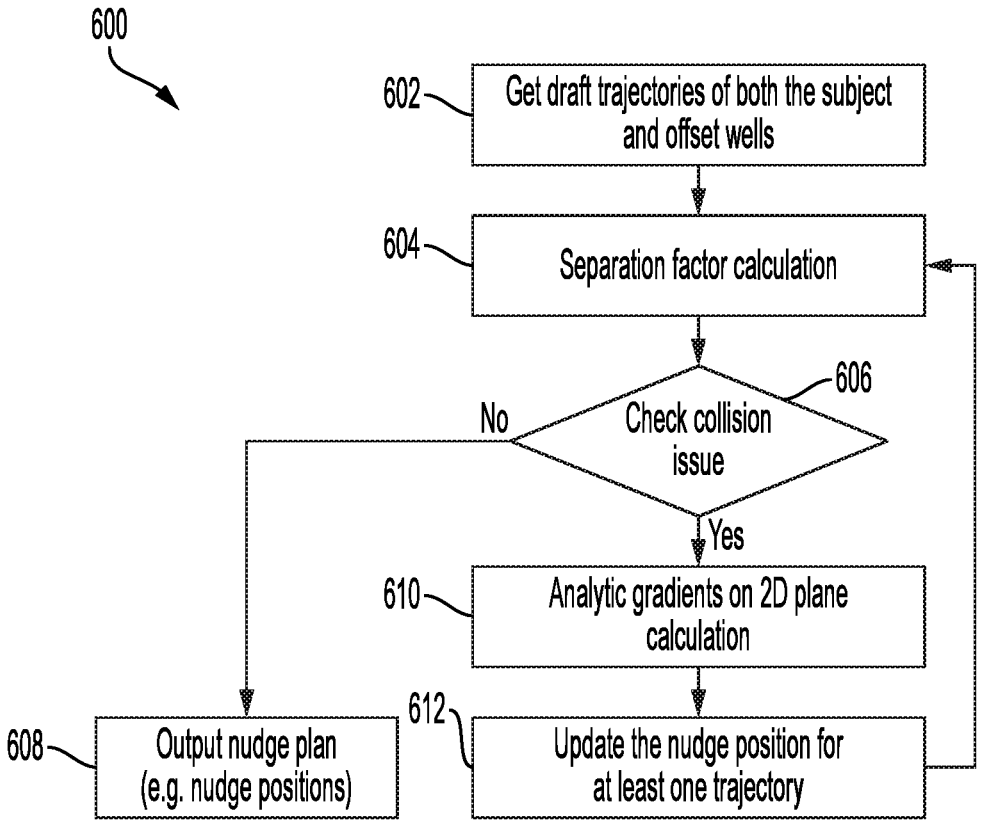
FIG. 6 is a flow diagram of a method for determining trajectories for a plurality of wells while avoiding collisions between wells according to some examples disclosed herein.

FIG. 6 is a flow diagram of a method 600 for determining trajectories for a plurality of wells while avoiding collisions between wells according to some examples disclosed herein. Method 600 may be implemented using processor system 1400 as shown and described below in reference to FIG. 14.

In general, method 600 operates iteratively as follows. Initially, assign the spatial locations of the trajectories to be nudged, and calculate the corresponding separation factors and their gradients give the zones of uncertainty. For the iteration, the nudge positions are calculated by a vector sum of the gradients (nudge vectors) that enlarge the separation factor the most and with smallest displacement. At each iteration, the collision risk for each trajectory is checked. When the separation factor value reaches a predetermined threshold (e.g., between 1.5 and 2.0), the corresponding nudge position are stored temporarily and not updated. As the iteration progresses, the global separation factor value is also checked. Once the global separation factor value gets larger than the predetermined threshold or the process reaches a predetermined maximum number of iterations, method 600 stops and returns the results (e.g., the nudge vectors).

Turning specifically to method 600 as depicted in FIG. 6, at 602, method 600 obtains draft (e.g., initial) trajectories for an offset well and one or more subject wells. Method 600 may obtain such trajectories by acquiring them from offset well libraries, well planning software, records of drilling equipment, or by manual entry by a user, for example. The draft trajectories may be acquired in terms of the spatial locations of trajectory to be nudged.

At 604, method 600 performs a separation factor calculation. In order to do so, method 600 determines a zone of uncertainty for the offset well and each subject well. Then, according to the current trajectory (e.g., the draft trajectory for the first iteration), method 600 calculates separation factors for each pair of wells.

In more detail, a separation factor (here an oriented separation factor) for an offset well located by way of non-limiting example at (0,0) and a primary well located by way of non-limiting example at (x, y) may be calculated as follows. On the horizontal plain, the respective ellipses of uncertainty may be described by their semi-major axes, semi-minor axes, and the angles between the major axis and the eastern direction (or northern direction). Denote $\alpha$ the angle between the semi-major axis of the primary well and the eastern (e.g., positive x-axis) direction, and denote $\beta$ the angle between the semi-major axis of the offset well and the eastern (e.g., positive x-axis) direction. Denote $a_1$ the length of the semi-major axis, and denote $b_1$ the length of the semi-minor axis, of the ellipse of uncertainty (which may be a projection of an ellipsoid of uncertainty) for the offset well. Denote $a_2$ the length of the semi-major axis, and denote $b_2$ the length of the semi-minor axis, of the ellipse of uncertainty (which may be a projection of an ellipsoid of uncertainty) for the primary well. Then the separation factor may be determined, by way of non-limiting example, as:

$$Osf = \frac{\sqrt{x^2+y^2}}{\sqrt{\frac{B_p k^2 + C_p k + A_p}{1+k^2}} + \sqrt{\frac{B_o k^2 + C_o k + A_o}{1+k^2}}} \tag{1}$$

The parameters in Equation (1) are as follows:

$$A_o = a_2^2 \cos^2 \alpha + b_2^2 \sin^2 \alpha \tag{2}$$

$$B_o = a_2^2 \sin^2 \alpha + b_2^2 \cos^2 \alpha \tag{3}$$

$$C_o = 2 \cos \alpha \sin \alpha \left(a_2^2 - b_2^2\right) \tag{4}$$

$$A_p = a_1^2 \cos^2 \beta + b_1^2 \sin^2 \beta \tag{5}$$

$$B_p = a_1^2 \sin^2 \beta + b_1^2 \cos^2 \beta \tag{6}$$

$$C_p = 2 \cos \beta \sin \beta \left(a_1^2 - b_1^2\right) \tag{7}$$

$$k = \frac{y}{x} \tag{8}$$

At 606, method 600 checks whether a collision is predicted. To do so, method 600 may determine local separation factors for each well as an initial step. Herein, a local separation factor for a particular well is the minimum separation factor among separation factors for each pair of wells that include the particular well. That is, the local separation factor for a particular well is the minimum separation factor for the particular well and any other well. Also at 606, method 600 determines a global separation factor for the wells. Herein, a global separation factor for the plurality of wells is the minimum separation factor relative to any pair of wells among the plurality of wells. The global separation factor may be calculated directly or derived as a minimum among all local separation factors, in examples for which local separation factors are determined. Method 600 proceeds to check whether the global separation factor exceeds a predetermined threshold. Example suitable thresholds include 1.5, 2.0, etc. If the global separation factor exceeds the threshold, then control passes to 608. Otherwise, if the global separation factor does not exceed the threshold, then control passes to 610.

At 608, the current nudge positions (e.g., nudge plan or nudge vectors) are output and method 600 ends. The nudge positions may be output by display on a computer screen, for example.

At 610, method 600 determines analytic gradients of separation factor functions for each pair of wells. This may include projecting ellipsoids of uncertainty for each well onto a horizontal plane and using a corresponding separation factor function relative to the resulting ellipses. The gradient $$\left(\frac{\partial SF}{\partial x}, \frac{\partial SF}{\partial y}\right)$$

at a point (x, y) in the horizontal plane may be determined, by way of non-limiting example, as:

$$\frac{\partial OSF}{\partial x} = \frac{2x}{\sqrt{M_p}+\sqrt{M_o}} - \frac{x^2+y^2}{\left(\sqrt{M_p}+\sqrt{M_o}\right)^2}\left(\frac{C_p y + 2A_p x}{2\sqrt{M_p}} + \frac{C_o y + 2A_o x}{2\sqrt{M_o}}\right) \tag{9}$$

$$\frac{\partial OSF}{\partial y} = \frac{2y}{\sqrt{M_p}+\sqrt{M_o}} - \frac{x^2+y^2}{\left(\sqrt{M_p}+\sqrt{M_o}\right)^2}\left(\frac{2B_p y + C_p x}{2\sqrt{M_p}} + \frac{2B_o y + C_o x}{2\sqrt{M_o}}\right) \tag{10}$$

The parameters in Equations (9) and (10) are defined above in reference to Equations (2)-(8) and as follows:

$$M_p = A_p x^2 + C_p xy + B_p y^2 \tag{11}$$

$$M_o = A_o x^2 + C_o xy + B_o y^2 \tag{12}$$

At 612, method 600 updates nudge positions for at least one well trajectory. Method 600 may store well trajectories in a position matrix according to some examples. Such a position matrix may be in the form of a vector of ordered pairs representing a nudge location, e.g., an azimuth direction and associated distance. At the initial iteration, each ordered pair may be the coordinates of each wellsite. This may be represented as, by way of non-limiting example:

$$(\overrightarrow{p_1^0})^T = (x_i^0, y_i^0) \tag{13}$$

In Equation (13), the superscript 0 represents the initial (0-th) iteration, and the subscript i represents the i-th well with wellsite at coordinates ($x_i^0$, $y_i^0$) (for i=1, . . . , n). That is, ($x_i^0$, $y_i^0$) represents the surface location on the horizontal plane of the i-th well. The ordered pairs may be updated for iteration t and represented as, by way of non-limiting example:

$$(\overrightarrow{p_1^t})^T = (x_i^t, y_i^t) \tag{14}$$

Thus, the position matrix for the t-th iteration may be represented as, by way of non-limiting example, the following n×2 matrix:

$$P^t = \begin{pmatrix} (\overrightarrow{p_1^t})^T \\ \vdots \\ (\overrightarrow{p_i^t})^T \\ \vdots \\ (\overrightarrow{p_n^t})^T \end{pmatrix} \tag{15}$$

The nudge positions represented by the position matrix may be updated per 612 using a move matrix containing nudge vectors for each well at iteration t. The nudge vector for the i-th well at iteration t may be represented as, by way of non-limiting example:

$$\overrightarrow{V_i^t} = \sum_{\substack{j=1 \\ j \neq i}}^{m_i^t} \overrightarrow{Grad}_{ij}^t \cdot \frac{1}{OSF_{ij}} \tag{16}$$

In Equation (16), $m_i^t$ represents the number of wells that have collision issues with the i-th well at iteration t (e.g., as determined per the techniques of 606), and the term $\overrightarrow{Grad}_{ij}^t$ represents the separation factor gradient for the i-th and j-th wells, which may be represented using Equations (9) and (10) as, by way of non-limiting example:

$$\overrightarrow{Grad}_{ij}^{t} = \begin{pmatrix} \frac{\partial OSF}{\partial x} \\ \frac{\partial OSF}{\partial y} \end{pmatrix} \tag{17}$$

To update for step t+1, the move matrix is constructed based on the nudge vector of each well, so that the nudging positions move along the separation factor increasing direction. Thus, the move matrix may be represented as, by way of non-limiting example:

$$\Delta P^{t} = \begin{pmatrix} (\overrightarrow{V_1^t})^T \\ \vdots \\ (\overrightarrow{V_i^t})^T \\ \vdots \\ (\overrightarrow{V_n^t})^T \end{pmatrix} \tag{18}$$

Thus, the position matrix for step t+1, $P^{t+1}$, may be determined as a sum of the position matrix from step t, $P^t$, and the move matrix from step t, $\Delta p^t$. In the sum, the move matrix may be scaled by a relax factor$\alpha$ between 0 and 1 to control the rate of iteration.

$$P^{t+1} = P^{t} + \alpha \Delta P^{t} \tag{19}$$

Note that if, during an iteration, a nudging position for a given well is "safe" (e.g., the minimum separation factor with other wells is larger than a safe separation factor threshold as determined per 606), then that position may not be updated in the iteration. This is accounted for by the term $m_i^t$ of Equation (16), which denotes the number of wells that have a collision issue with the i-th well at step t.

After 612, control reverts to 604. The iteration may continue until no collision issue is detected at 606, or a predetermined number of iteration steps have been completed, whichever occurs first, according to some examples.

Figure 7:
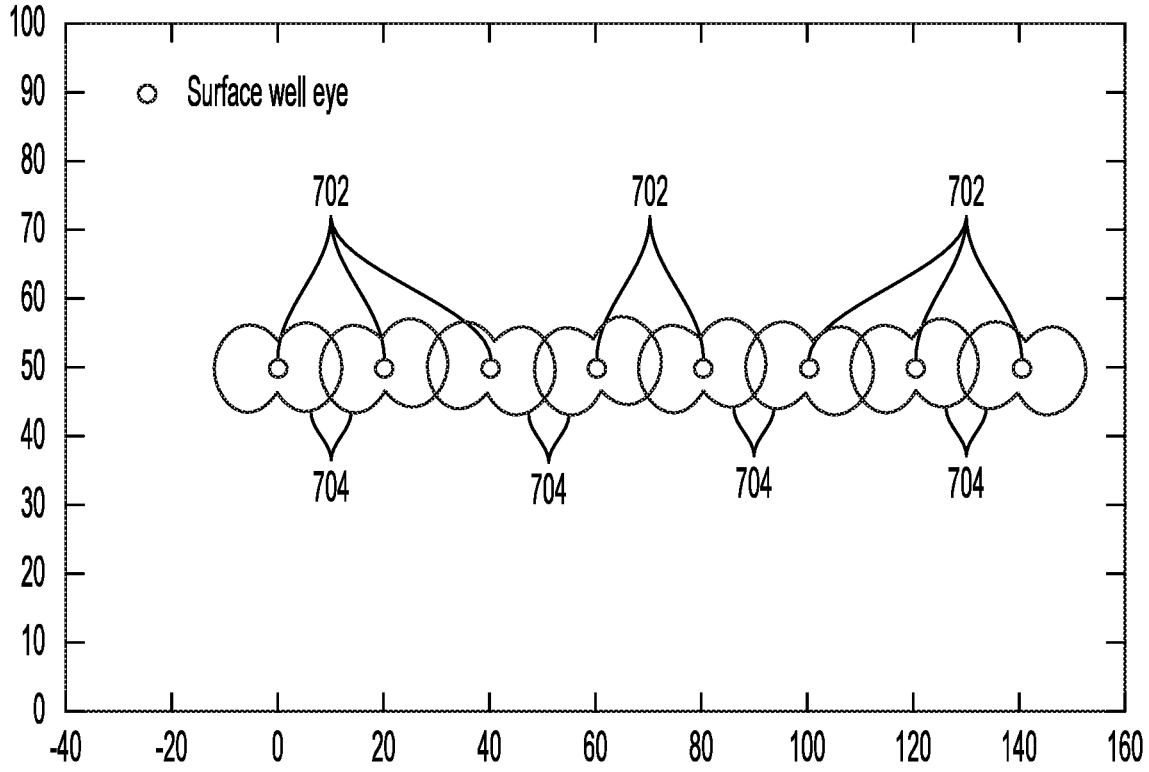
FIG. 7 illustrates initial surface locations of a plurality of wells on a pad according to some examples disclosed herein.

FIG. 7 illustrates initial surface locations of a plurality of wells 702 on a pad according to some examples disclosed herein. In particular, FIG. 7 depicts an example use case for examples, namely, pad design for multiple wells. As shown, there are eight wells 702 in line, and their zones of uncertainty 704 (here, pedal curves) intersect with each other. Thus, a trajectory nudge scheme is needed.

Figure 8:
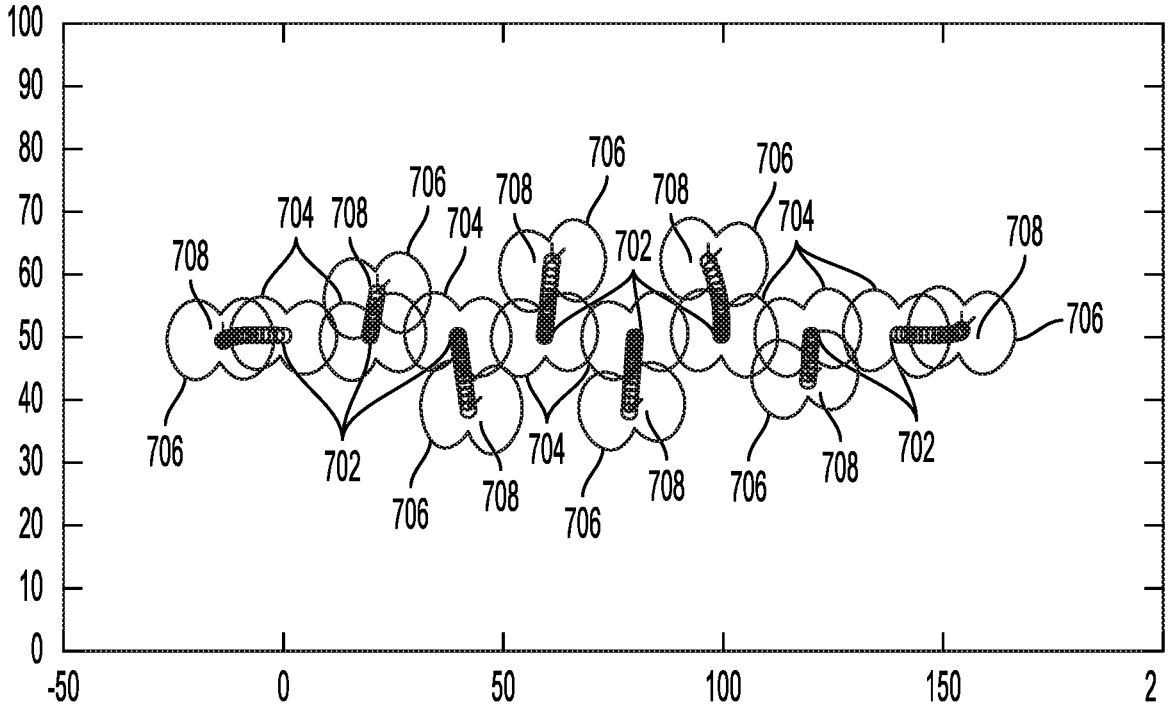
FIG. 8 illustrates nudge locations for the wells of FIG. 7 according to some examples disclosed herein.

FIG. 8 illustrates nudge locations for the wells 702 of FIG. 7 according to some examples disclosed herein. As shown, nudge positions 708 represent optimized locations where the trajectories should be nudged to for collision free trajectories (e.g., with separation factors larger than certain threshold) with minimum displacements for the wells 702. Note that the zones of uncertainty 706 (here, pedal curves) for the nudged trajectories do not intersect.

Figure 9:
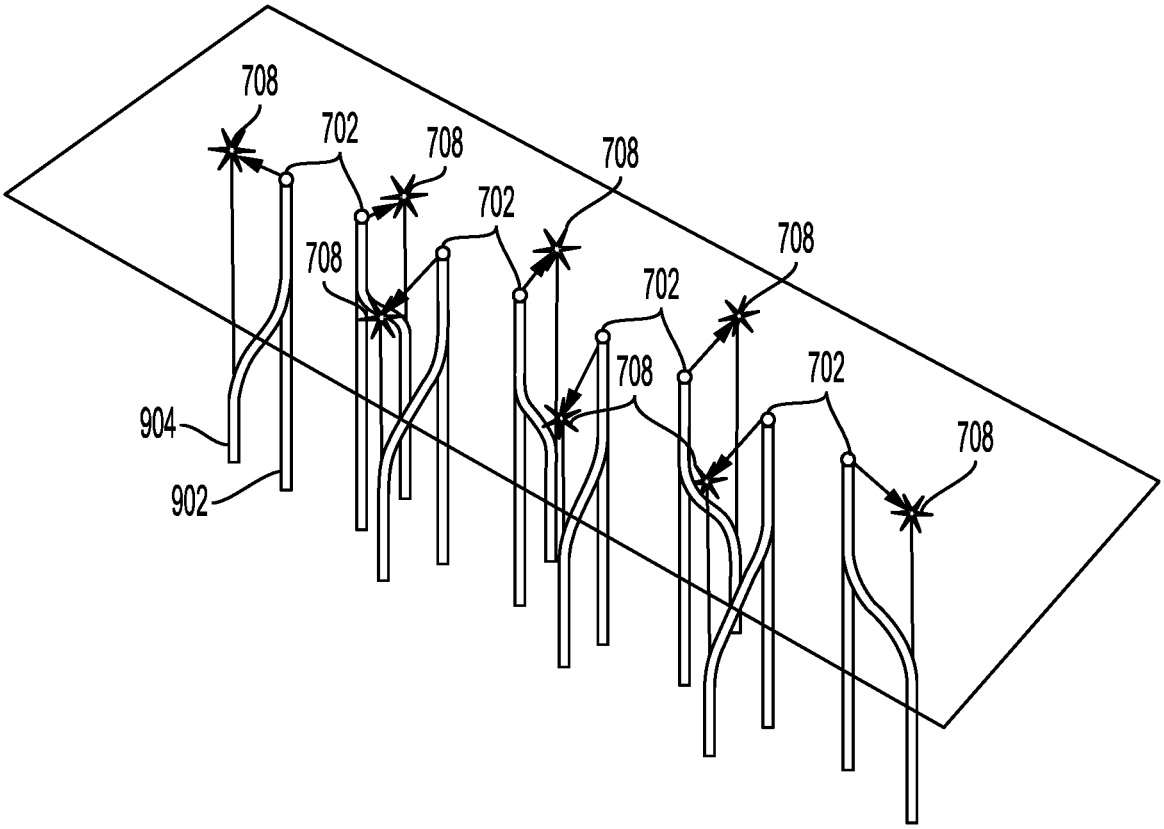
FIG. 9 illustrates planned trajectory changes based on the nudge locations of FIG. 8 according to some examples disclosed herein.

FIG. 9 illustrates planned trajectory changes based on the nudge locations of FIG. 8 according to some examples disclosed herein. Thus, FIG. 9 depicts the surface positions of wells 702 and the associated nudge positions 708. Note that the original vertical segments, e.g., 902, are diverted to planed trajectories, e.g., 904, based on the nudge positions 708.

Figure 10:
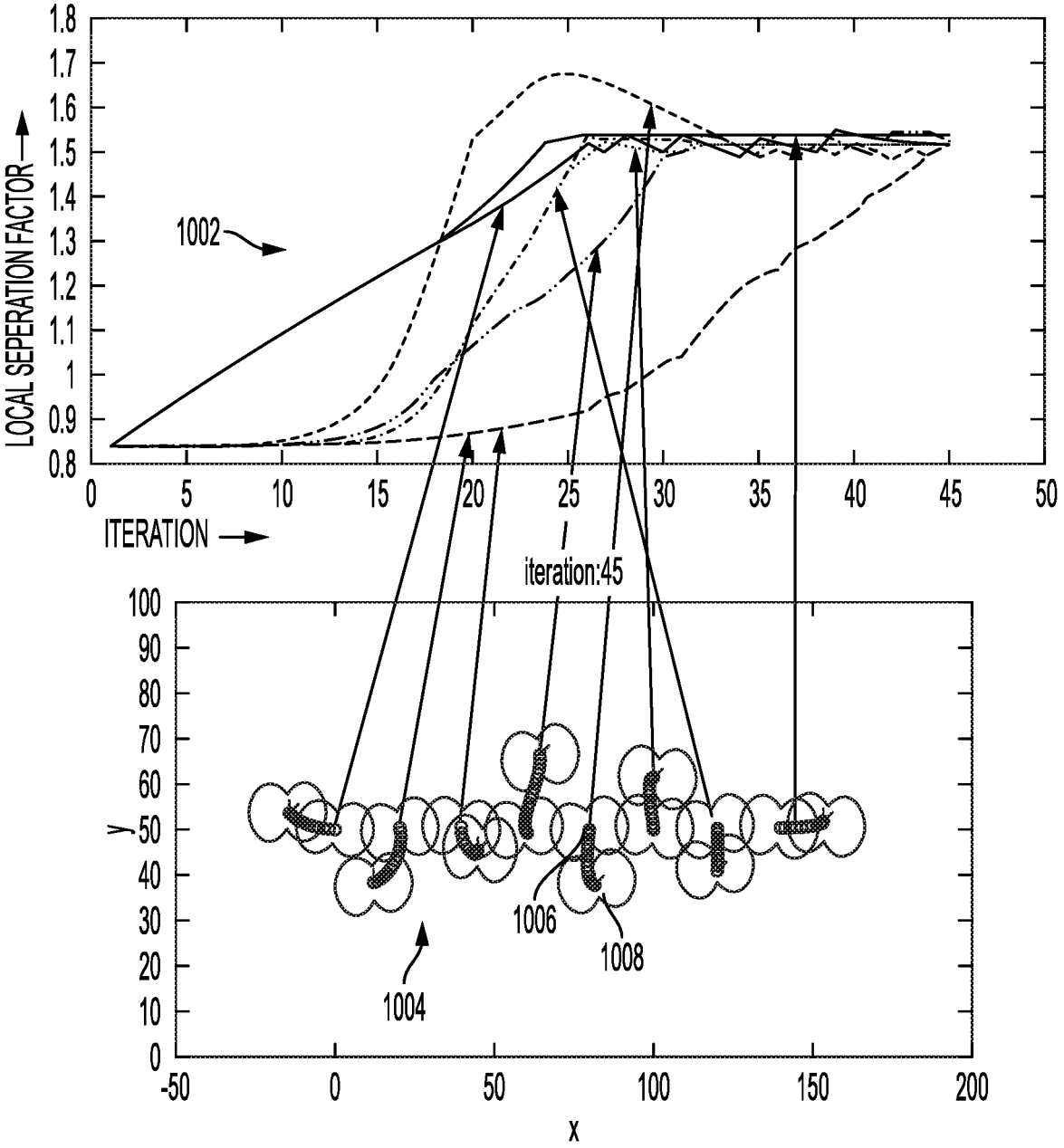
FIG. 10 illustrates local separation factors for a plurality of wells throughout an iteration of a method for determining collision-avoiding trajectories for the wells according to some examples disclosed herein.

FIG. 10 illustrates local separation factors 1002 for a plurality of wells 1004 throughout an iteration of a method for determining collision-avoiding trajectories for the wells according to some examples disclosed herein. The local separation factors 1002 for wells 1004 may be as described above in reference to 606 of method 600, that is, the local separation factor for a particular well is the minimum separation factor for the particular well and any other well. Note that the local separation factors 1002 generally increase as the iterations progress. Note that in particular, the local separation factor for well 1006 exceeds the predetermined separation factor threshold of 1.5 in iterations 19 through 34. Therefore, the corresponding nudge position 1008 is not updated in iterations 19-34.

Figure 11:
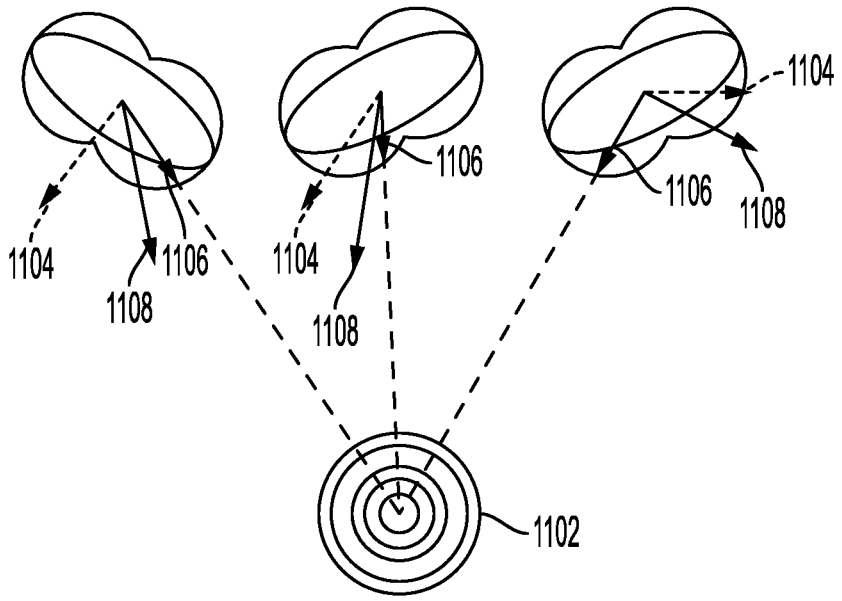
FIG. 11 illustrates a technique for directing wells to one or more target locations according to some examples disclosed herein.

FIG. 11 illustrates a technique for directing wells to one or more target locations 1102 according to some examples disclosed herein. In particular, method 600 of FIG. 6 may be adapted to both avoid collisions between wells and direct one or more trajectories to a selected target, e.g., at target location 1102. During the iteration, the effect of the target locations 1102 may be accounted for, because shortening the trajectory to the targets typically reduces unnecessary costs. Method 600 may be adapted by adding small push vectors 1106 that direct the trajectories toward the target 1102. Such push vectors 1106 may be added to the nudge vectors 1104, e.g., by adapting Equation (16).

In more detail, method 600 may be adapted to direct trajectories to one or more targets as follows. Initially, identify the underground target location(s) and their projection(s) on the surface. Next, according to some examples, the surface projection of the nearest target to the wellsites are selected. According to other examples, the nearest target might not be the best choice for the first the target selection, however, selecting the nearest target is likely the most common. Next, for each target surface location 1102, as shown in FIG. 11, in each iteration step of method 600, add each target oriented push vector 1106 to its respective nudge vector 1104 to obtain target-adjusted vectors 1108. The target-adjusted vectors 1108 are then used as a new force to separate nudge positions. The following equations may be used to formalize this process. The target-induced push vectors $\vec{V}_t$ are calculated by scaling vector differences from current positions $\vec{p}$ of the nudges to the target position(s) $\vec{p}_t$. This scaling process may be represented as follows, by way of non-limiting example:

$$\vec{V}_t = \frac{\vec{p_t} - \vec{p}}{\|\vec{p_t} - \vec{p}\|} \tag{20}$$

In Equation (20), $\vec{V}_t$ represents the target-induced push vectors, $\vec{p}$ represents current nudge positions, and $\vec{p}_t$ represents the target position(s). Equation (16) may be adapted by adding the target-induced push vector of Equation (20), which may be represented as follows, by way of non-limiting example:

$$\vec{V}_i^t = \sum_{\substack{j=1 \\ j \neq i}}^{m_i^t} \overrightarrow{Grad}_{ij}^{t} \cdot \frac{1}{OSF_{ij}} + \alpha \vec{V}_t \tag{21}$$

In Equation (21), the parameters are as described above in reference to Equations (16) and (20). Thus, employing method 600 with Equation (21) substituted for Equation (16) may be used to determine trajectories for a plurality of wells while directing trajectories to one or more targets and avoiding collisions between wells.

Figure 12:
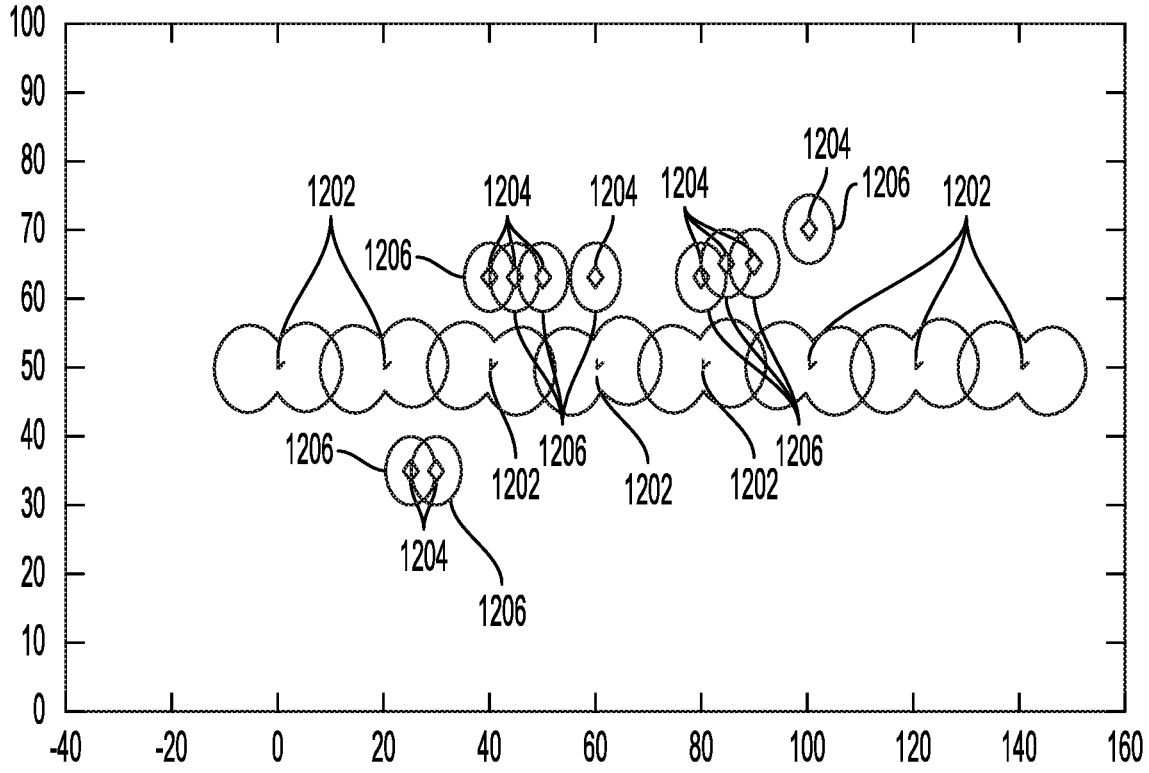
FIG. 12 illustrates surface locations of a plurality of wells and a plurality of obstacles according to some examples disclosed herein.

FIG. 12 illustrates surface locations of a plurality of wells 1202 and a plurality of obstacles 1204 according to some examples disclosed herein. According to some examples, the disclosed technique for determining trajectories for a plurality of wells while avoiding collision between wells may be adapted to avoid underground obstacles, e.g., obstacles 1204. Any of a variety of obstacles may be avoided, including geological faults, anti-targets, etc. To do so, method 600 is adapted for collisions between the trajectories and the obstacles. The obstacles may be associated with zones of uncertainty 1206, which may be utilized for determining separation factors and gradients e.g., as disclosed in reference to Equations (1)-(12). The zones of uncertainty 1206 may be regularly shaped, e.g., circular, such that the calculations are relatively simple. Further, in method 600, the locations of obstacles 1204 and zones of uncertainty 1206 are held constant throughout the iteration. With these changes, method 600 is adapted to avoid obstacles while determining trajectories for a plurality of wells while avoiding collision between the wells.

Figure 13:
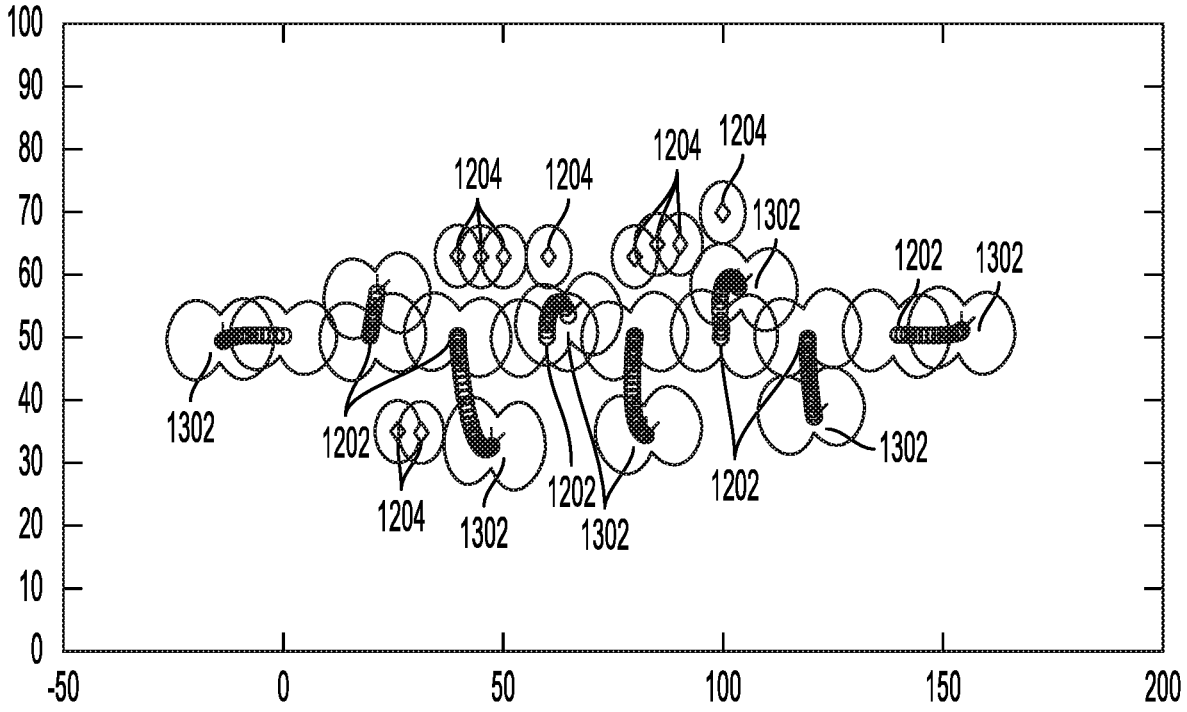
FIG. 13 illustrates nudge locations that avoid collisions and obstacles for the wells of FIG. 12.

FIG. 13 illustrates nudge positions 1302 that avoid collisions and obstacles for the wells 1202 of FIG. 12. That is, FIG. 12 depicts the results of applying method 600 adapted as described above in reference to FIG. 12 to wells 1202 and obstacles 1204. The resulting nudge positions 1302 both avoid collisions between wells 1202 and avoid obstacles 1204.

Figure 14:
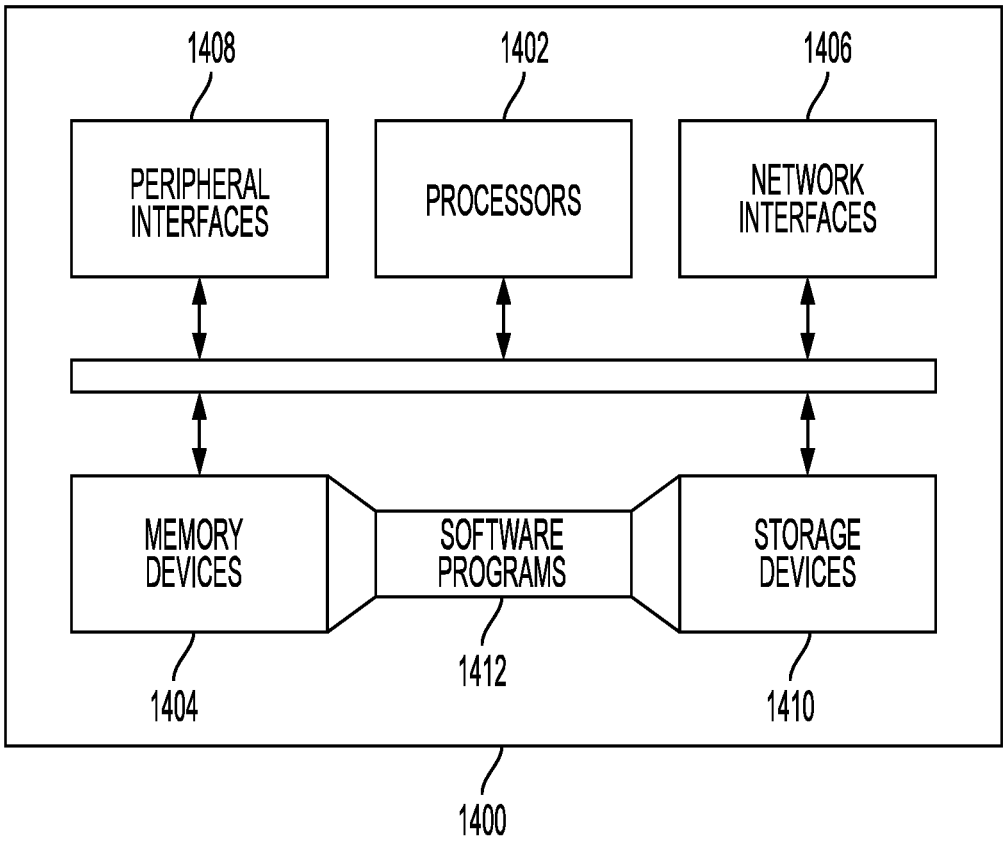
FIG. 14 illustrates a schematic view of a computing or processor system for implementing one or more examples of the methods disclosed herein.

FIG. 14 illustrates a schematic view of a computing or processor system 1400 for implementing one or more examples of the methods disclosed herein. The processor system 1400 may include one or more processors 1402 of varying core configurations (including multiple cores) and clock frequencies. The one or more processors 1402 may be operable to execute instructions, apply logic, etc. It will be appreciated that these functions may be provided by multiple processors or multiple cores on a single chip operating in parallel and/or communicably linked together. In at least one example, the one or more processors 1402 may be or include one or more GPUs.

The processor system 1400 may also include a memory system, which may be or include one or more memory devices and/or computer-readable media 1404 of varying physical dimensions, accessibility, storage capacities, etc. such as flash drives, hard drives, disks, random access memory, etc., for storing data, such as images, files, and program instructions for execution by the processor 1402. In an example, the computer-readable media 1404 may store instructions that, when executed by the processor 1402, are configured to cause the processor system 1400 to perform operations. For example, execution of such instructions may cause the processor system 1400 to implement one or more portions and/or examples of the method(s) described above, e.g., the methods of FIGS. 4 and/or 7.

The processor system 1400 may also include one or more network interfaces 1406. The network interfaces 1406 may include any hardware, applications, and/or other software. Accordingly, the network interfaces 1406 may include Ethernet adapters, wireless transceivers, PCI interfaces, and/or serial network components, for communicating over wired or wireless media using protocols, such as Ethernet, wireless Ethernet, etc.

As an example, the processor system 1400 may be a mobile device that includes one or more network interfaces for communication of information. For example, a mobile device may include a wireless network interface (e.g., operable via one or more IEEE 802.11 protocols, ETSI GSM, BLUETOOTH®, satellite, etc.). As an example, a mobile device may include components such as a main processor, memory, a display, display graphics circuitry (e.g., optionally including touch and gesture circuitry), a SIM slot, audio/video circuitry, motion processing circuitry (e.g., accelerometer, gyroscope), wireless LAN circuitry, smart card circuitry, transmitter circuitry, GPS circuitry, and a battery. As an example, a mobile device may be configured as a cell phone, a tablet, etc. As an example, a method may be implemented (e.g., wholly or in part) using a mobile device. As an example, a system may include one or more mobile devices.

The processor system 1400 may further include one or more peripheral interfaces 1408, for communication with a display, projector, keyboards, mice, touchpads, sensors, other types of input and/or output peripherals, and/or the like. In some implementations, the components of processor system 1400 need not be enclosed within a single enclosure or even located in close proximity to one another, but in other implementations, the components and/or others may be provided in a single enclosure. As an example, a system may be a distributed environment, for example, a so-called "cloud" environment where various devices, components, etc. interact for purposes of data storage, communications, computing, etc. As an example, a method may be implemented in a distributed environment (e.g., wholly or in part as a cloud-based service).

As an example, information may be input from a display (e.g., a touchscreen), output to a display or both. As an example, information may be output to a projector, a laser device, a printer, etc. such that the information may be viewed. As an example, information may be output stereographically or holographically. As to a printer, consider a 2D or a 3D printer. As an example, a 3D printer may include one or more substances that can be output to construct a 3D object. For example, data may be provided to a 3D printer to construct a 3D representation of a subterranean formation. As an example, layers may be constructed in 3D (e.g., horizons, etc.), geobodies constructed in 3D, etc. As an example, holes, fractures, etc., may be constructed in 3D (e.g., as positive structures, as negative structures, etc.).

The memory device 1404 may be physically or logically arranged or configured to store data on one or more storage devices 1410. The storage device 1410 may include one or more file systems or databases in any suitable format. The storage device 1410 may also include one or more software programs 1412, which may contain interpretable or executable instructions for performing one or more of the disclosed processes. When requested by the processor 1402, one or more of the software programs 1412, or a portion thereof, may be loaded from the storage devices 1410 to the memory devices 1404 for execution by the processor 1402.

Those skilled in the art will appreciate that the above-described componentry is merely one example of a hardware configuration, as the processor system 1400 may include any type of hardware components, including any accompanying firmware or software, for performing the disclosed implementations. The processor system 1400 may also be implemented in part or in whole by electronic circuit components or processors, such as application-specific integrated circuits (ASICs) or field-programmable gate arrays (FPGAs).

The foregoing description of the present disclosure, along with its associated examples, has been presented for purposes of illustration. It is not exhaustive and does not limit the present disclosure to the precise form disclosed. Those skilled in the art will appreciate from the foregoing description that modifications and variations are possible in light of the above teachings or may be acquired from practicing the disclosed examples.

For example, the same techniques described herein with reference to the processor system 1400 may be used to execute programs according to instructions received from another program or from another processor system altogether. Similarly, commands may be received, executed, and their output returned entirely within the processing and/or memory of the processor system 1400. Accordingly, neither a visual interface command terminal nor any terminal at all is strictly necessary for performing the described examples.

Likewise, the steps described need not be performed in the same sequence discussed or with the same degree of separation. Various steps may be omitted, repeated, combined, or divided, as appropriate to achieve the same or similar objectives or enhancements. Accordingly, the present disclosure is not limited to the above-described examples, but instead is defined by the appended claims in light of their full scope of equivalents. Further, in the above description and in the below claims, unless specified otherwise, the term "execute" and its variants are to be interpreted as pertaining to any operation of program code or instructions on a device, whether compiled, interpreted, or run using other techniques. In the claims that follow, section 112 paragraph sixth is not invoked unless the phrase "means for" is used.

What is claimed is:

1. A computer-implemented method of determining trajectories for a plurality of wells while avoiding collision between wells, the method comprising:

determining, by one or more processors of the computer, a zone of uncertainty for individual wells of the plurality of wells, whereby a plurality of zones of uncertainty are determined, and wherein each of the plurality of zones of uncertainty comprises a range of potential deviated locations for a location of a borehole of the respective individual well with respect to an expected location of the borehole;

determining, by the one or more processors of the computer, based on the plurality of zones of uncertainty, a minimum separation factor for individual wells of the plurality of wells, whereby a plurality of minimum separation factors is determined, and wherein determining the minimum separation factor for a respective individual well comprises:

determining a plurality of separation factors for the respective individual well, wherein the plurality of separation factors includes a separation factor for each pair of the respective individual well and another well of the plurality of wells, and wherein determining the separation factor for each respective pair is based on a distance between a first center of the respective individual well and a second center of the other well, a first zone of uncertainty of the respective individual well, and a second zone of uncertainty of the other well; and determining the minimum separation factor from the plurality of separation factors;

determining, by the one or more processors of the computer, a gradient of a separation factor for at least one pair of the respective individual well and other well based on the respective plurality of separation factors, first zone of uncertainty, and second zone of uncertainty;

updating, in a memory system of the computer, a nudge position for at least one well of the plurality of wells, based on the separation factor gradient and the plurality of separation factors;

providing, by the one or more processors of the computer, based on the updating, nudge positions for the individual wells of the plurality of wells; and outputting, by the one or more processors of the computer, a set of recommended collision-free nudging vectors to a display of the computer.

2. The method of claim 1, wherein the nudge positions for the individual wells of the plurality of wells cause the individual wells to avoid an obstacle.

3. The method of claim 1, wherein the nudge positions for the individual wells of the plurality of wells cause at least one well to intersect a target.

4. The method of claim 1, wherein the plurality of wells comprises at least three wells.

5. The method of claim 1, wherein the plurality of minimum separation factors is based on an oriented separation factor formula.

6. The method of claim 1, wherein at least one zone of uncertainty of the plurality of zones of uncertainty lies in a plane and comprises at least one of an ellipse or a pedal curve.

7. The method of claim 1, wherein the updating the nudge position comprises updating a position matrix with a move matrix comprising a plurality of nudge vectors.

8. The method of claim 1, further comprising iterating, prior to the providing, the determining the zone of uncertainty, the determining the minimum separation factor, the determining the gradient of the separation factor, and the updating, until a stop condition occurs.

9. The method of claim 8, wherein the stop condition comprises at least one of a global minimum separation factor being above a predetermined threshold or a number of iterations exceeding a predetermined iteration ceiling, wherein the global minimum separation factor is based on the plurality of minimum separation factors.

10. The method of claim 1, further comprising not updating a nudge position for at least one well based on its minimum separation factor exceeding a threshold.

11. A computer system for determining trajectories for a plurality of wells while avoiding collision between wells, the system comprising at least one electronic processor that executes instructions to perform operations comprising:

determining, by the at least one electronic processor, a zone of uncertainty for individual wells of the plurality of wells, whereby a plurality of zones of uncertainty are determined, and wherein each of the plurality of zones of uncertainty comprises a range of potential deviated locations for a location of a borehole of the respective individual well with respect to an expected location of the borehole;

determining, by the at least one electronic processor, based on the plurality of zones of uncertainty, a minimum separation factor for individual wells of the plurality of wells, whereby a plurality of minimum separation factors is determined, and wherein determining the minimum separation factor for a respective individual well comprises:

determining a plurality of separation factors for the respective individual well, wherein the plurality of separation factors includes a separation factor for each pair of the respective individual well and another well of the plurality of wells, and wherein determining the separation factor for each respective pair is based on a distance between a first center of the respective individual well and a second center of the other well, a first zone of uncertainty of the respective individual well, and a second zone of uncertainty of the other well; and determining the minimum separation factor from the plurality of separation factors;

determining, by the at least one electronic processor, a gradient of a separation factor for at least one pair of the respective individual well and other well based on the respective plurality of separation factors, first zone of uncertainty, and second zone of uncertainty;

updating, in a memory system of the system, a nudge position for at least one well of the plurality of wells, based on the separation factor gradient and the plurality of separation factors;

providing, by the at least one electronic processor, based on the updating, nudge positions for the individual wells of the plurality of wells; and outputting, by the at least one electronic processor, a set of recommended collision-free nudging vectors to a display of the system.

12. The system of claim 11, wherein the nudge positions for the individual wells of the plurality of wells cause the individual wells to avoid an obstacle.

13. The system of claim 11, wherein the nudge positions for the individual wells of the plurality of wells cause at least one well to intersect a target.

14. The system of claim 11, wherein the plurality of wells comprises at least three wells.

15. The system of claim 11, wherein the plurality of minimum separation factors is based on an oriented separation factor formula.

16. The system of claim 11, wherein at least one zone of uncertainty of the plurality of zones of uncertainty lies in a plane and comprises at least one of an ellipse or a pedal curve.

17. The system of claim 11, wherein the updating the nudge position comprises updating a position matrix with a move matrix comprising a plurality of nudge vectors.

18. The system of claim 11, wherein the operations further comprise iterating, prior to the providing, the determining the zone of uncertainty, the determining the minimum separation factor, the determining the gradient of the separation factor, and the updating, until a stop condition occurs.

19. The system of claim 18, wherein the stop condition comprises at least one of a global minimum separation factor being above a predetermined threshold or a number of iterations exceeding a predetermined iteration ceiling, wherein the global minimum separation factor is based on the plurality of minimum separation factors.

20. The system of claim 11, wherein the operations further comprise not updating a nudge position for at least one well based on its minimum separation factor exceeding a threshold.

* * * * *